United States Patent [19]

Shoebotham

[11] 4,456,455

[45] Jun. 26, 1984

[54] TWO STAGE COAL GASIFICATION PLANT

[75] Inventor: Neville M. Shoebotham, Benoni, South Africa

[73] Assignee: Fluidised Bed Combustion (Proprietary) Limited, South Africa

[21] Appl. No.: 360,979

[22] Filed: Mar. 23, 1982

[30] Foreign Application Priority Data

Mar. 23, 1981 [ZA] South Africa ..... 81/1910

[51] Int. Cl.[3] ..... C10B 9/00

[52] U.S. Cl. ..... 48/85.2; 48/85.1; 48/76; 48/87

[58] Field of Search ..... 48/76, 85.2, 85.1, 87; 202/221

[56] References Cited

U.S. PATENT DOCUMENTS

| | | | |
|---|---|---|---|
| 2,440,940 | 5/1948 | Galusha | 48/76 |
| 3,454,382 | 7/1969 | Hamilton | 48/76 |
| 4,225,392 | 9/1980 | Taylor | 48/85 X |

*Primary Examiner*—Arthur D. Kellogg

*Attorney, Agent, or Firm*—Bacon & Thomas

[57] ABSTRACT

This invention relates to a two stage coal gasification plant which comprises a gasifier 1 and a predistillation retort 2. The gasifier has a plurality of gas extraction outlets 4 located in the periphery thereof which feed into a manifold 5 from where a percentage of the gas from the gasifier is extracted. Gas from the predistillation retort is extracted through an outlet near the top of the retort. An agitator 8 is provided for agitation of the coal in the agglomeration zone. The agitator is preferably automatically controlled by means of a temperature sensing device 10 located on an arm thereof.

3 Claims, 1 Drawing Figure

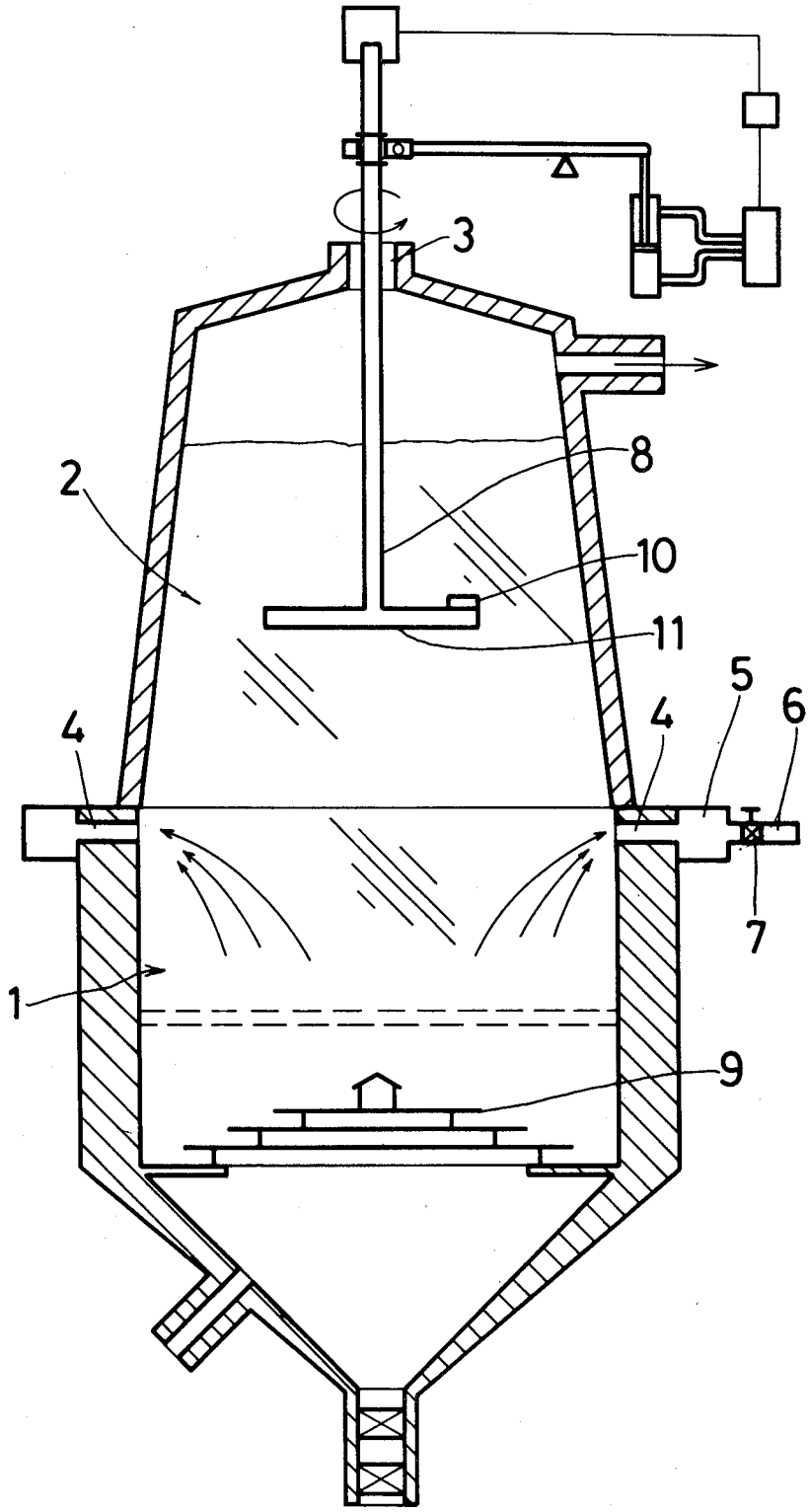
3
2
8
10
11
5
6
4
4
7
1
9

TWO STAGE COAL GASIFICATION PLANT

BACKGROUND TO THE INVENTION

This invention relates to a retort for coal gasification plant and more specifically relates to a retort used in a two stage gas production plant.

A coal gasification plant which employs a two stage process extracts gases from two points in the plant. The gases are extracted firstly from the gasifier and secondly from near the top of the predistilation retort and are known as bottom gas and top gas respectively. Bottom gas is relatively free from coal tars and the like whilst top gas contains a relatively high percentage of tars and it is thus desirous to keep the two gases seperate until the tar has been removed from the top gas. Most prior art retorts use a complex arrangemnt of flues and gas communication passages to draw the bottom gas around the coal in the retort up to near the top of the retort from where it is extracted. The reason bottom gas was drawn up through the retort passages was because it was believed that heat, emitted by the flues carrying the bottom gas, was transmitted to the coal in the retort and contributed significantly to the distillation thereof.

Retorts are usually made from refractory materials and thus constructing the arrangement of flues and gas communication passages is both a complicated and expensive operation. Simplification of the retort allows the introduction of an agitator to break up coal agglomerates when coking coals are employed.

It is an object of the present invention to provide a two stage gasification plant in which the above-described problems are, at least to some extent eliminated.

It is a further object of the invention to provide a retort in which the carbonaceous material in the distillation zone can be agitated in use.

SUMMARY OF THE INVENTION

In accordance with this invention there is provided a two stage coal gasification plant comprising a predistillation retort and a gasifier in which a percentage of the gas produced in the gasifier is extracted directly from the gasifier.

Further there is provided for the extraction of gas to be effected through points around the perimeter of the gasifier.

Still further there is provided for the gas to be collected in a manifold around the gasifier and from there to be extracted.

Further there is provided for an agitator to be located in the predistillation retort.

Yet further there is provided for the agitator to comprise a rotatable shaft the agitating end of which has located thereon a least one projection which projects transversely relative to the shaft axis.

Further there is provided for the axis of the shaft of the agitator to be substantially coincident with the axis of the predistillation retort and for the level of the agitating end of the agitator to be adjustable relative to the predistillation retort.

Further there is provided for the agitator to be adjustable to a level in the retort which corresponds with a specific temperature range.

Further there is provided for this adjustment to be automatically controlled.

SHORT DESCRIPTION OF THE DRAWING

These and further features of the invention will become apparent from a description of an embodiment thereof given here by way of example. Reference is made to the accompanying drawing which shows a section through the retort and gasifier of a two stage gasification plant.

DETAILED DESCRIPTION OF THE DRAWING

Referring to the drawing, a two stage gasification plant comprises a gasifier 1 and pre-distillation retort 2. The plant is fed with a bituminous coal through an inlet 3. The coal basically passes through two stages in the gasifier process, the first being in the pre-distillation retort 2 where volatile gases are driven off by destructive distillation and the second in the gasifier 1 where the coal is completely gasified. The coal thereafter passes out of the plant in the form of coke through a grate 9.

The volatile gases distilled in the pre-distillation retort (top gas) contain a high percentage of tars whilst the gases from the gasifier (bottom gas) are relatively clean and need only to be freed from dust before being usable. To keep the two gases separate the gasifier is provided with a plurality of outlet apertures 4 through which gas in the gasifier discharges. Each aperture 4 discharges gas into a manifold 5 which has a single outlet 6 through which the gas is extracted. The outlet 6 has a closure member 7 located thereon which is used to control the amount of gas drawn from the gasifier. For the distillation process to operate efficiently a certain proportion of the bottom gas must be allowed to pass through the pre-distillation retort and mix with the volatile gases. The proportion is controlled by the outlet 7.

One specific advantage of drawing the bottom gas from the gasifier itself is that the retort remains free from the flues and gas passages that constricted many prior art retorts. This has the advantage that the retort does not easily clog. In addition the retort remains free for the introduction of an agitator 8 into it.

The agitator 8 is rotatable about an axis which is coaxial with that of the retort. The agitator may be inserted into the retort to different depths in the predistillation zone and rotation thereof ensures the breaking up of agglomerated coal. The problem of uneven flow of coal and hangups in the retort is thus largely eliminated.

The agitator will preferably be set so as to operate mainly in the zone in which agglomeration takes place. The position and depth of this zone within the retort varies according to the type of coal being used and the rate of gasification. Agglomeration however occurs within a specific temperature range and so the variation of depth of the agitator will be automatically controlled so that agitation occurs in this temperature zone.

Temperature measuring equipment indicated diagramatically at numeral 10 will be mounted on the agitator and may comprise a thermostat or the like mounted on one of the arms 11 of the agitator.

An agitator as described will allow for a far wider range of quality and size of coals to be used as the problem of agglomeration will have been largely eliminated. It will be appreciated that the cost of the gas thus produced will be less than that produced in a gasifier where agglomeration is a problem.

There may be many variations to the above-described embodiment without departing from the scope of the invention. Obviously the invention may be applied to gasification plants of different shapes and gas outputs. The shape of the agitator in particular and its method of operation could be varied considerably and yet still fall within the scope of the invention. The method by which the bottom gas is drawn off could in addition be varied quite considerably by for example, altering the means by which the gas is collected.

What I claim as new and desire to secure by Letters Patent is:

1. A two stage coal gasification plant comprising a predistillation retort in surmounted relation to a gasifier, the gasifier having a plurality of gas extraction outlets located around the periphery thereof, an agitator comprising a shaft being mounted for rotation in the predistillation retort and including at least one projection which projects transversely relative to the shaft and adapted to effect agitation of coal on rotation of the shaft, the rotational axis of the shaft being substantially coincident with that of the predestillation retort, the elevation of the projetion being adjustable relative to the predistillation retort, the agitator including temperature sensing means thereon, and control means for adjusting the elevation of the projection relative to the predistillation retort in response to the temperature sensed by the temperature sensing means.

2. A two stage coal gasification plant as claimed in claim 1, wherein the sensed temperature is automatically relayed to the control means which automatically adjusts the elevation of the projection in accordance with the sensed temperature.

3. A two stage coal gasification plant as claimed in claim 2 wherein the elevation of the projection is adapted to vary automatically within a preselected temperature range.

* * * * *